United States Patent [19]

Westover

[11] 3,964,359

[45] June 22, 1976

[54] APPARATUS FOR CUTTING SHEET MATERIAL

[75] Inventor: Dwight G. Westover, Sierra Madre, Calif.

[73] Assignee: Bell & Howell Company, Chicago, Ill.

[22] Filed: Oct. 24, 1974

[21] Appl. No.: 517,553

[52] U.S. Cl. ..... 83/430; 83/482; 83/500

[51] Int. Cl.[2] ..... B26D 1/28

[58] Field of Search ..... 83/430, 482, 500, 503, 83/501, 502

[56] References Cited

UNITED STATES PATENTS

| | | | |
|---|---|---|---|
| 219,842 | 9/1879 | Beach | 83/500 |
| 614,252 | 11/1898 | Mayhew | 83/503 X |
| 801,916 | 10/1905 | Rudolphi | 83/430 |
| 940,862 | 11/1909 | Daniel et al. | 83/501 |
| 1,120,394 | 12/1914 | Lilleberg | 83/500 X |
| 1,951,529 | 3/1934 | Possnett | 83/501 |
| 2,241,395 | 5/1941 | Egling | 83/430 |
| 2,785,749 | 3/1957 | Wilson et al. | 83/430 X |
| 3,122,040 | 2/1964 | Bishop | 83/430 X |
| 3,621,746 | 11/1971 | Womack | 83/430 |
| 3,855,890 | 12/1974 | Lynch et al. | 83/482 X |

*Primary Examiner*—Frank T. Yost
*Attorney, Agent, or Firm*—Benoit Law Corporation

[57] ABSTRACT

Apparatus for cutting sheet material suitable for use with a card-dispensing business machine is disclosed. The apparatus includes cooperative roller mechanism having side by side cylindrical portions of selected different diameters, which define cutting edges to slit sheet material fed therethrough. The cutting edges are preferably formed by undercutting the ends of the cylindrical roller portions defining the cutting edges, thereby to form sharp cutting surfaces.

49 Claims, 8 Drawing Figures

10
11
12
13
14
15
16
17
20
21
30
31
40
41
41a
41b
42
42a
42b
43
44
45
46
47
50
51
52
53
54
55
60
70
71
81
2

FIG. 3
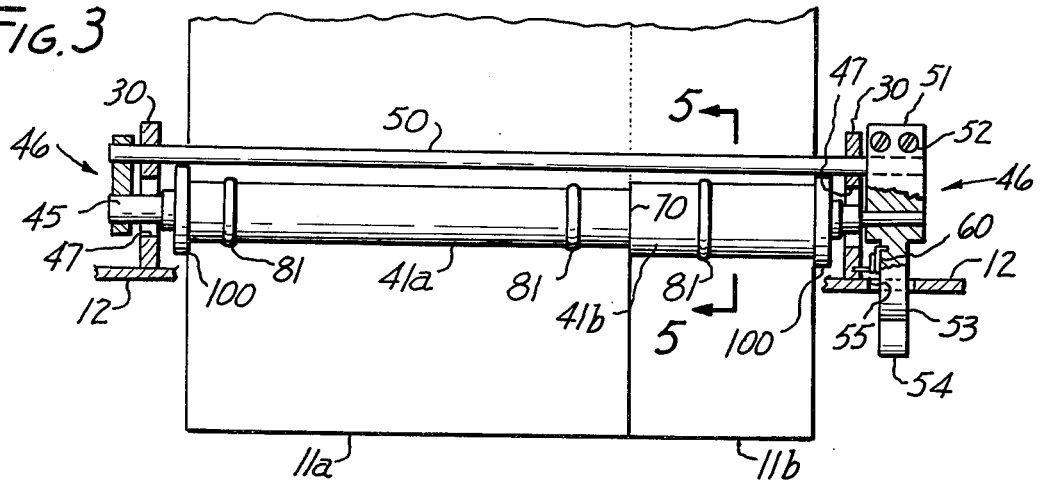
FIG. 4
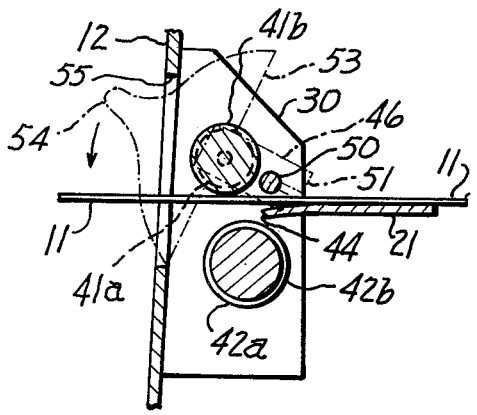
FIG. 5
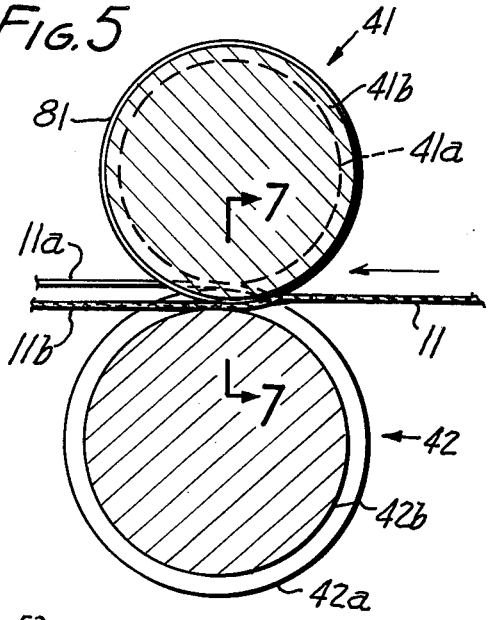
FIG. 6
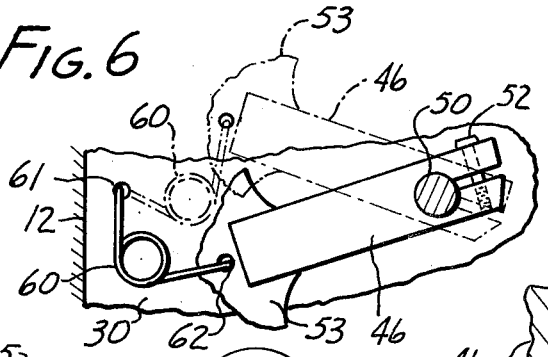
FIG. 7
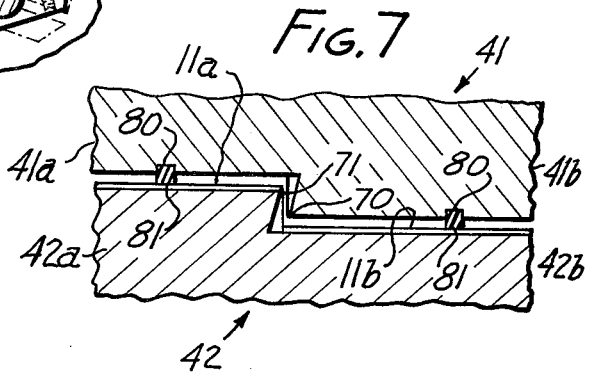
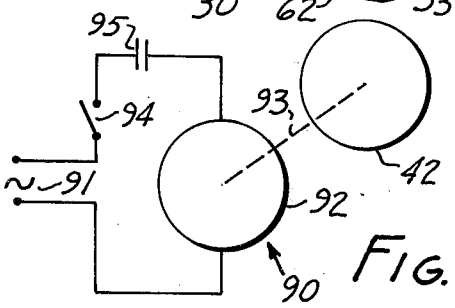
FIG. 8

APPARATUS FOR CUTTING SHEET MATERIAL

BACKGROUNND OF THE INVENTION

The present invention relates to apparatus for cutting sheet material. More particularly, the present invention relates to such cutting apparatus suitable for use with card-dispensing business machines for selectively dividing dispensed business cards into separate parts.

Business cards, forms and the like, are commonly made for being divided into several parts. For example, a business card may be formed to have two information containing portions which may be separated once information has been imprinted thereon in order to provide a record for a customer as well as a record of the transaction for a merchant.

Commonly such business cards are made with weakened lines formed therein to facilitate separation along these weakened lines of strength. A common way of forming such weakened lines of strength in the cards is by perforating or precutting them to form tear lines.

Several drawbacks exist with the use of business cards, forms and the like having such tear lines formed therein. One drawback is that the cards must be specially processed in order to form the tear lines therein. This special processing adds to the expense of preparing the cards. Another drawback is that the cards sometimes do not readily separate along their tear lines, i.e., the preformed tear lines malfunction. Such malfunctioning may occur, for example, because the tear lines were improperly formed when the cards were made. Malfunctioning may also occur if the cards are not properly pulled apart. As a result of such malfunctioning, one of the portions of the business cards may be inadvertently torn or mutilated. An additional disadvantage with the use of such business cards having tear lines formed therein is that in some instances the cards tear unevenly therealong. A further disadvantage associated with such cards is that the presence of the preformed tear lines therein, or of uneven torn portions thereon, prevent the processing of the cards through certain types of automated business machines. For example, cards are frequently provided in a continuous form for high speed processing. In such continuous form, perforated tear lines are formed for subsequent separation of the cards (called "bursting"). If parts of the cards are to be separable from each other during subsequent use, then additional tear lines are required in the continuous form. This raises the danger that the cards burst along these additional tear lines during high speed processing. Accordingly, the additional tear lines have to be designed with the dangers of high speed processing in mind, rather than with regard to the subsequent user of the card and to his convenience in separating card parts along perforations.

Several drawbacks exist also with other sheet material cutting devices that use knives which are subject to relatively fast dulling or which are dangerous to operate.

SUMMARY OF THE INVENTION

It is an object of the present invention to provide an improved apparatus for cutting sheet material.

it is further an object of the present invention to provide an improved cutting apparatus as set forth characterized by being capable of slitting sheet material fed therethrough along selected lines, thereby to obviate the need of forming along these selected lines tear or other weakened lines of strength.

It is additionally an object of the present invention to provide an improved cutting apparatus as set forth characterized by being suitable for use in combination with card-dispensing business machines.

It is a related object of the present invention to provide improved apparatus and methods for cutting sheet material without the use of conventional knife structures.

It is additionally an object of the present invention to reduce or eliminate the danger to the operator now inherent in conventional sheet material cutting equipment.

Other objects will become apparent in the further course of this disclosure.

In accomplishing these and other objects, there is provided in accordance with the present invention apparatus for cutting sheet material which includes cooperating roller mechanism having side by side cylindrical portions of selected different diameters, which define cutting edges to slit sheet material fed therethrough. The cutting edges are preferably formed by undercutting the ends of the cylindrical portions defining the cutting edges, thereby to form sharp cutting surfaces.

The cutting apparatus is illustrated in combination with a card-dispensing business machine and selectively operates to separate cards dispensed therefrom into separate portions. The roller mechanism is illustrated formed by a pair of rollers which are pivotably moveable between a material receiving position and a material engaging cutting position.

Additional objects of the present invention reside in the specific construction of the cutting apparatus hereinafter shown in the drawings and described in connection therewith.

BRIEF DESCRIPTION OF DRAWINGS

FIG. 3 is an elevation view of the pivotal roller of the roller mechanism of the cutting apparatus of FIG. 1.

FIG. 4 is a cross-sectional view of the roller mechanism of the cutting apparatus of FIG. 1, illustrating the roller mechanism thereof selectively positioned in its material receiving position.

FIG. 5 is a cross-sectional view of the roller mechanism of the cutting apparatus of FIG. 1, illustrating the roller mechanism positioned in its material engaging cutting position.

FIG. 6 is a side view of the overcenter spring mechanism associated with the pivotal roller of the roller mechanism of the cutting apparatus of FIG. 1.

FIG. 7 is a view taken along the line 7—7 of FIG. 5.

FIG. 8 is a circuit diagram of a motor drive arrangement for driving the cutting apparatus of FIG. 1 when its roller mechanism is positioned in its material engaging cutting position.

DETAILED DESCRIPTION OF THE PREFERRED EMBODIMENT

Figures 1, 2:
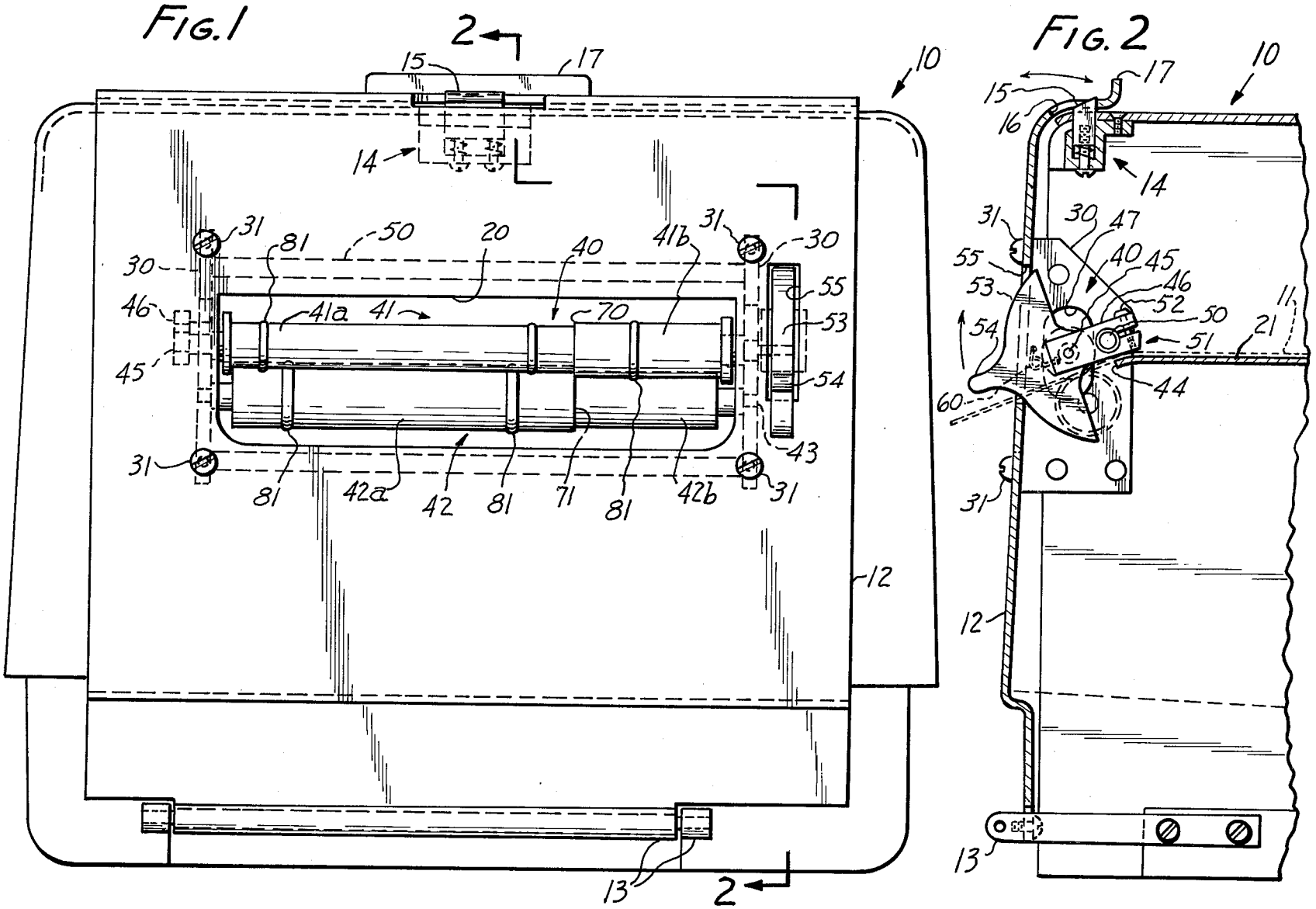
FIG. 1 is an elevation view of a cutting apparatus according to the present invention mounted on a card-dispensing business machine.
FIG. 2 is a view taken along the line 2—2 of the FIG. 1.

Referring to the drawings in more detail, there is shown in FIGS. 1 and 2 a conventional business machine generally identified by the numeral 10. The business machine 10 is of a card-dispensing type and operates upon selective actuation thereof in a conventional manner to dispense a business card 11 therefrom. As shown in FIG. 2, the business card 11 is dispensed along the guide surface 21 to extend a predetermined distance from the machine 10.

The business machine 10, for example, may be a cash register, which operates to dispense a sales slip or a ticket therefrom, or a utility bill dispenser which separates a stub for automatic processing.

The portion of the business machine 10 through which the business card 11 is dispensed is closed by a door 12. The door 12 is pivotally mounted on its lower end by structure 13 and is latched closed on its upper end by latch mechanism 14. A depressable latch number 15 of the mechanism 14 mates with an opening 16 formed centrally in the upper end of the door 12. The door 12 may be opened by selectively depressing the latch member 15 to depress its associated latch spring while pulling the door handle 17 away from the machine 10. To reclose the door 12, the door 12 needs merely to be pushed upwardly against the machine 10 and the latch member 15 automatically latches in the latch receiving opening 16.

The door 12 has formed therein a card dispensing opening 20. The card dispensing opening 20 is formed in alignment with the card guide structure 21, along which the business cards 11 are guided and dispensed from the machine 10. The card dispensing opening 20 is illustrated formed in a substantially rectangular shape, having longitudinal edges which extend horizontally and side edges which extend vertically.

Mounted on the inside surface of the door 12 are brackets 30 adjacent the ends of the opening 20. The brackets 30 are mounted on the door 12 by screws 31 and are illustrated extending vertically.

The brackets 30 form a part of the sheet material cutting apparatus generally identified by the numeral 40. The cutting apparatus 40 is mounted within the business machine 10 in alignment with the card guide structure 21 to receive cards 11 dispensed therefrom through the card dispensing opening 20. The cutting apparatus 40 is formed by roller mechanism which includes first and second rollers 41 and 42. Roller 42 is mounted for rotation on shaft 43 in a fixed position to extend between the brace structure provided by the brackets 30. The roller 42 is preferably positioned just below the outer edge 44 of the card guide structure 21 to extend parallel therewith. The roller 41 is rotatably mounted on shaft 45 to extend between support arms or levers 46. The support arms 46 are positioned outwardly of the brackets 30 and the shaft 45 is mounted in the outwardly positioned ends of the arms 46.

An opening 47 is formed in each bracket 30 through which extends the roller shaft 45.

Rotatably mounted to extend through the brackets 30 between the arms 46 in a position parallel to the guide structure edge 44, but slightly thereabove, is pivot rod 50. Pivot rod 50 rotatably extends through the brackets 30 and is fixedly secured to the inwardly positioned ends of the lever arms 46. The lever arms 46 are secured to the pivot rod 50 in a mutually aligned parallel relationship by clamp structure 51 formed on the inner ends of the arms 46. The clamp structure 51 may be tightened to secure the lever arms 46 in the fixed positions on the rod 50 by tightening the screws 52, shown in FIG. 2.

Secured to the outer end of one of the lever arms 46 is an arcuately shaped lever extension 53 having an outwardly projecting handle 54 formed thereon. The lever extension 53 and its handle 54 extend through a vertically extending substantially rectangularly shaped slot 55 formed in the door 12. With the handle 54 moved downwardly adjacent the lower edge of the slot 55, the roller mechanism 40 is moved into the material engaging cutting position shown in FIG. 5, in which the upwardly positioned roller 41 is pivoted downwardly into contact with the lower roller 42. Upward movement of the handle 54 to a position adjacent the upper edge of the slot 55 moves the cutting apparatus 40 into the material receiving position shown in FIG. 4.

FIG. 6 illustrates an overcenter spring mechanism 60 associated with the pivotable lever extension 53 and its handle 54. The overcenter spring 60 has one end 61 anchored in a hole in bracket structure 30 while its other end 62 is anchored in a hole in the lever extension 53. Thereby, the overcenter spring 60 operates to hold the extension 53 and its handle 54, either in the lower position shown in FIG. 2 or its upper position shown in FIG. 4, until manually shifted, as indicated by the arrows in FIGS. 2 and 4, between these two positions.

Each of the rollers 41 and 42 are made up of two longitudinal sections having different diameters. The roller 41 is made up of longitudinal sections 41a and 41b. Section **41*b* has a diameter a predetermined distance larger than the diameter of section 41*a*. The sections 41a and 41b are positioned adjacent each other to define the cutting edge 70, and as shown in FIG. 7, the end of the cylindrical portion 41*b* is undercut at a predetermined angle, such as 10 degrees, to form the cutting edge 70** as an extremely sharp surface.

The lower positioned roller 42 is made up of cylindrical sections **42*a* and 42*b*. The cylindrical section 42*a* has a diameter a predetermined distance greater than the diameter of the section 42*b*. This difference in diameters between the cylindrical sections 42*a* and 42*b* is preferably substantially equal to the difference in diameters between the cylindrical sections 41*a* and 41*b*, and the roller sections 41*b* and 42*b* constitute a means for overdriving the cut strip emerging between the roller sections 41*b* and 42*b* relative to the strip emerging between the roller sections 41*a* and 42*a* (in other words, driving the cut strip emerging between the roller sections 41*b* and 42*b* faster than the strip emerging between the roller sections 41*a* and 42*a***), thereby preventing the card being cut from bulging and improving the cutting action.

The roller sections **42*a* and 42*b* are positioned side by side and form a cutting edge 71 immediately adjacent to cutting edge 70. The end of the cylindrical portion 42*a* is undercut to form this cutting edge 71** as an extremely sharp surface.

The rollers 41 and 42 are positioned so that the cutting edges 70 and 71 overlap. This is accomplished by aligning the rollers 41 and 42 so that the roller portions **41*a*, 42*a* and 41*b*, 42*b* are positioned, respectively, in longitudinally aligned relationship. The over-lapping relationship of the cutting edges 70 and 71 is shown in detail in FIG. 7**.

In lieu of having the rollers 41 and 42 in substantially direct rotational contact with each other, circumferential grooves 80 are shown formed therein for holding annular frictional contact members 81. As shown in FIGS. 1 and 7, the members 81, which are illustrated as O-rings, provide frictional surfaces for engaging sheet material, i.e. the cards 11, as they are fed therethrough.

FIG. 8 illustrates a motor drive circuit arrangement 90 for selectively feeding a card 11 through the cutting apparatus 40. The motor drive arrangement 90 is powered by an electric source 91 and includes a motor 92. The motor 92 is connected, as indicated by the line 93, to drive the roller 42. Two switches are provided in the circuit arrangement 90. The first switch is an on/off switch 94.

The switch 94 operates, when opened, to disable the motor driving circuit 90. The second switch is a normally open cam actuated switch 95. The switch 95 is actuated closed by shifting the handle 54 to its lower position shown in FIG. 2. Upon closure of the switch 95, the motor is driven, if the on/off switch 94 is closed, to rotate the lower roller 42 to feed a card 11 therethrough.

It is noted, as shown in FIG. 5, that the mating cylindrical portions of the rollers 41 and 42 preferably have different circumferences so that one roller runs slightly faster than the other in order to provide better cutting action of the cutting apparatus 40. As there shown, the cylindrical portion 42*a* is of larger diameter than both the cylindrical portion 41*b* and 41*a*.

For purposes of explaining the operation of the cutting apparatus 40, business machine 10 is hereinafter assumed to be a cash register. In operation, a sales transaction is rung up on the cash register 10. The cash register 10 operates in a conventional manner to imprint information for the merchant on the half business card 11 aligned with the roller sections 41*a*, 42*a*, while simultaneously imprinting information for the customer on the portion of the card 11 aligned with the roller sections 41*b*, 42*b*. The business card sections aligned with, respectively, the roller sections 41*a*, 42*a*, and 41*b*, 42*b*, are hereinafter identified as card sections 11a and 11b.

During the time the sales transaction is being entered into the cash register 10, the lever handle 54 should be shifted to its upper position, as shown in FIG. 4. Once the sales transaction has been completely entered into the cash register 10, the cash register 10 operates in a conventional manner to eject or dispense the business card 11. The card 11 is dispensed along the guide structure 21 to the position shown in FIG. 2 in dotted lines in which its leading edge extends a selected distance, such as one inch, outwardly from the door 12. It is noted that circularly shaped guides 100 are mounted on the ends of the roller 41 which extend perpendicular to the roller axis to guide the cards 11 from the machine 10 through the roller mechanism. The lever handle 54 is then shifted downwardly to its lower position shown in FIG. 2. Whereupon, with the on/off switch 94 closed, the cam switch 95 closes and the motor 90 is driven to rotate the lower roller 42. The rotating roller 42 causes the card 11 to be pulled through the cooperating roller mechanism provided by the rollers 41 and 42 in the manner shown in FIG. 5. As the card 11 is pulled through the rollers 41 and 42, the cutting edges 70 and 71 operate to slit, cut and thereby separate the card 11 into the card portions 11*a* and 11*b*.

As mentioned above, the portion 11*b* is preferably overdriven relative to the portion 11a to prevent bulging of the card being cut and improve the cutting action by the cutting edges 70 and 71. This overdrive is kept within reasonable limits by leaving a relatively low friction surface of the roller portion 42*b* exposed and providing a high friction ring element 81 only on the roller portion 41*b*. In this manner, the card portion 11*b* can slip relative to the roller portion 42*b*.

It is noted that since the cutting apparatus 40 only slits the card 11 when the mechanism is positioned in its card engaging cutting position, the card portion extending forwardly from the roller mechanism out the card dispensing opening 20 should be preslit. It is also noted that the card 11 may be manually slit by simply gripping the leading edge of the card 11 and pulling it through the roller mechanism once the handle 54 has been depressed. When using the cutting, apparatus 40 in this manual mode of operation, the on/off switch 94 should be opened to disable the motor drive circuit 90, or the motor and motor drive circuit may be deleted.

Further, instead of preslitting the leading portion of the cards 11, the cutting apparatus 40 could be mounted with respect to the business machine 10 so that the dispensed cards 11 would extend just to a position between the rollers 41 and 42. Thereby, depression of the lever handle 54 to actuate the motor 92 would automatically pull substantially the complete length of the card 11 therethrough. Also auxiliary mechanism could be provided for advancing the dispensed cards 11 into the cutting apparatus 40 once the motor 92 had been energized.

Although the invention has herein been shown and described in what is conceived to be the most practical preferred embodiment, it is recognized that departures may be made therefrom within the scope of this invention.

For instance, the roller 42 may be driven mechanically, such as by a rack and pinion mechanism (not shown), instead of electrically.

What is claimed is:

1. Apparatus for cutting sheet material, comprising:

roller means including first and second rollers, each of said rollers being formed by at least two side by side longitudinally aligned concentric cylindrical portions having relatively larger and smaller diameters whereby on each of said rollers the end edge of said larger cylindrical portion adjacent said smaller cylindrical portion defines a circular cutting edge;

means for positioning said rollers in a cooperating substantially parallel disposed relationship with respect to each other with said defined circular cutting edges overlapping and positioned adjacent each other whereby a piece of sheet material fed between said rollers is engaged thereby and slit into separate parts by the rotating action of said cutting edges; and motor means responsive to the positioning of said rollers for driving said rollers whenever said rollers are positioned in said material engaging position thereby to feed a piece of sheet material therebetween.

2. The invention defined in claim 1, wherein the end edges of said cylindrical portions defining said cutting edges are undercut.

3. The invention defined in claim 1, wherein the end edges of said cylindrical portions defining said cutting edges are undercut at approximately an angle of ten degrees measured from a perpendicular to the longitudinal axis of its associated one of said rollers.

4. The invention defined in claim 1, wherein said positioning means is also selectively operable to move said rollers from their material engaging cooperating position in which sheet material fed therethrough is cut to a spaced apart material receiving position.

5. The invention defined in claim 4, wherein said positioning means includes selectively operable means for pivoting said rollers on command between said material receiving position and said material engaging position.

6. The invention defined in claim 1, including selectively operable motor means for driving said rollers to feed a piece of sheet material therebetween.

7. The invention defined in claim 1, including annular frictional contact surfaces formed around said rollers for engaging a piece of sheet material fed therebetween.

8. The invention defined in claim 1, wherein said first and second rollers are positioned with respect to each other with said larger cylindrical portion of one aligned with said smaller cylindrical portion of the other and vice versa.

9. The invention defined in claim 8, wherein the difference in diameter between said larger and smaller cylindrical portions of said first roller is substantially equal to the difference in diameter between said larger and smaller cylindrical portions of said second roller.

10. The invention defined in claim 8, wherein said larger cylindrical portions on said rollers have different diameters whereby said rollers rotate at different rates when a piece of sheet material is fed therebetween to increase the cutting action of said cutting edges.

11. The invention defined in claim 1, wherein said roller means include means for driving one of said sheet material parts faster than the other of said sheet material parts whereby to avoid bulging of said sheet material and improve the slitting action by said rollers.

12. The invention defined by claim 11, wherein said roller means include means for enabling slippage between said one sheet material part relative to said roller means.

13. The invention defined in claim 1, in combination with a card-dispensing business machine, said roller means being positioned to receive cards dispensed from said business machine and including guide structure formed adjacent the ends of said rollers to guide cards dispensed from said business machine between said rollers.

14. Apparatus for cutting sheet material, comprising:

roller means including first and second rollers, each of said rollers being formed by at least two side by side longitudinally aligned concentric cylindrical portions having relatively larger and smaller diameters whereby on each of said rollers the end edge of said larger cylindrical portion adjacent said smaller cylindrical portion defines a circular cutting edge, the difference in diameter between said larger and smaller cylindrical portions on said first roller being substantially equal to the difference in diameter between said larger and smaller cylindrical portions on said second roller;

structure means mounting said rollers in a substantially parallel disposed relationship with respect to each other with said larger cylindrical portion of one of said rollers aligned with said smaller cylindrical portion of the other and vice versa, said structure means being selectively operable on command to move said rollers between a material receiving position and a material engaging position, said rollers being spaced apart in said material receiving position and being positioned together in a rotatably cooperating relationship in said material engaging position with said defined circular cutting edges overlapping and positioned adjacent each other, said rollers being operable in said material engaging position to engage a piece of sheet material fed therebetween to slit the material into separate parts by the rotating action of said cutting edges; and overcenter spring means for biasing said rollers in said material receiving position or said material engaging position once said rollers have been positioned in one of said two positions.

15. The invention defined in claim 14, wherein the end edges of said cylindrical portions defining said cutting edges are undercut.

16. The invention defined in claim 14, including selectively operable motor means for driving said rollers to feed a piece of sheet material therebetween.

17. The invention defined in claim 14, including annular frictional contact surfaces formed around said rollers for engaging a piece of sheet material fed therebetween.

18. The invention defined in claim 14, wherein said larger cylindrical portions on said rollers have different diameters whereby said rollers rotate at different rates when positioned together in said rotatably cooperating relationship to engage a piece of sheet material fed therebetween thereby to increase the cutting action of said cutting edges.

19. The invention defined in claim 14 in combination with a card-dispensing business machine, said roller means being positioned to receive cards dispensed from said business machine and including guide structure formed adjacent the ends of said rollers to guide cards dispensed from said business machine between said rollers.

20. The invention defined in claim 14, wherein said structure means is operable to pivot said rollers on command between said material receiving position and said material engaging position.

21. The invention defined in claim 20, wherein:

said first roller is mounted in a fixed position; and said second roller is mounted for pivotal movement relative to said second roller.

22. The invention defined in claim 20, including motor means responsive to the positioning of said rollers for driving said rollers whenever said rollers are positioned in said material engaging position thereby to feed a piece of sheet material therebetween.

23. The invention defined in claim 14, wherein said roller means include means for driving one of said sheet material parts faster than the other of said sheet material parts whereby to avoid bulging of said sheet material and improve the slitting action by said rollers.

24. The invention defined in claim 23, wherein said roller means include means for enabling slippage between said one sheet material part relative to said roller means.

25. Apparatus for cutting sheet material comprising roller means having a pair of cooperating rollers each made up of cylindrical portions of selected different diameters whereby on each of said rollers the end edge of a relatively larger cylindrical portion adjacent a relatively smaller cylindrical portion defines a circular cutting edge, said rollers being positionable with their cutting edges overlapping and adjacent whereby a piece of sheet material fed between said rollers is engaged thereby and slit into separate parts by the rotating action of said cutting edges, and said roller means including means for driving one of said sheet material parts faster than the other of said sheet material parts whereby to avoid bulging of said sheet material and improve the slitting action by said rollers.

26. The invention defined in claim 25, wherein said roller means include means for enabling slippage between said one sheet material part relative to said roller means.

27. The invention defined in claim 25, in combination with a card-dispensing business machine, said roller means being positioned to receive and slit cards dispensed from said business machine.

28. Apparatus for cutting sheet material, comprising:

roller means including first and second rollers, each of said rollers being formed by at least two side by side longitudinally aligned concentric cylindrical portions having relatively larger and smaller diameters whereby on each of said rollers the end edge of said larger cylindrical portion adjacent said smaller cylindrical portion defines a circular cutting edge; and structure means mounting said rollers in a cooperating substantially parallel disposed relationship with respect to each other with said defined circular cutting edges overlapping and positioned adjacent each other whereby a piece of sheet material fed between said rollers is engaged thereby and slit into separate parts by the rotating action of said cutting edges;

said first and second rollers being positioned with respect to each other with said larger cylindrical portion of one aligned with said smaller cylindrical portion of the other and vice versa; and said larger cylindrical portions on said rollers having different diameters whereby said rollers rotate at different rates when a piece of sheet material is fed therebetween to increase the cutting action of said cutting edges.

29. The invention defined in claim 28, wherein said structure means is also selectively operable to move said rollers from their material engaging cooperating position in which sheet material fed therethrough is cut to a spaced apart material receiving position.

30. The invention defined in claim 29, wherein said structure means includes selectively operable means for pivoting said rollers on command between said material receiving position and said material engaging position.

31. The invention defined in claim 30, including motor means responsive to the positioning of said rollers for driving said rollers whenever said rollers are positioned in said material engaging position thereby to feed a piece of sheet material therebetween.

32. The invention defined in claim 28, including annular frictional contact surfaces formed around said rollers for engaging a piece of sheet material fed therebetween.

33. The invention defined in claim 28, wherein said first and second rollers are positioned with respect to each other with said larger cylindrical portion of one aligned with said smaller cylindrical portion of the other and vice versa.

34. The invention defined in claim 33, wherein said larger cylindrical portions on said rollers have different diameters whereby said rollers rotate at different rates when a piece of sheet material is fed therebetween to increase the cutting action of said cutting edges.

35. The invention defined in claim 28, wherein said roller means include means for driving one of said sheet material parts faster than the other of said sheet material parts whereby to avoid bulging of said sheet material and improve the slitting action by said rollers.

36. The invention defined by claim 35, wherein said roller means include means for enabling slippage between said one sheet material part relative to said roller means.

37. Apparatus for cutting sheet material, comprising:

roller means including first and second rollers, each of said rollers being formed by at least two side by side longitudinally aligned concentric cylindrical portions having relatively larger and smaller diameters whereby on each of said rollers the end edge of said larger cylindrical portion adjacent said smaller cylindrical portion defines a circular cutting edge; and structure means mounting said rollers in a substantially parallel disposed relationship with respect to each other with said larger cylindrical portion of one of said rollers aligned with said smaller cylindrical portion of the other and vice versa, said structure means being selectively operable on command to move said rollers between a material receiving position and a material engaging position, said rollers being spaced apart in said material receiving position and being positioned together in a rotatably cooperating relationship in said material engaging position with said defined circular cutting edges overlapping and positioned adjacent each other, said rollers being operable in said material engaging position to engage a piece of sheet material fed therebetween to slit the material into separate parts by the rotating action of said cutting edges;

said larger cylindrical portions on said rollers have different diameters whereby said rollers rotate at different rates when positioned together in said rotatably cooperating relationship to engage a piece of sheet material fed therebetween thereby to increase the cutting action of said cutting edges.

38. The invention defined in claim 37, including annular frictional contact surfaces formed around said rollers for engaging a piece of sheet material fed therebetween.

39. The invention defined in claim 37 in combination with a card-dispensing business machine, said roller means being positioned to receive cards dispensed from said business machine and including guide structure formed adjacent the ends of said rollers to guide cards dispensed from said business machine between said rollers.

40. The invention defined in claim 37, wherein said structure means is operable to pivot said rollers on command between said material receiving position and said material engaging position.

41. The invention defined in claim 40, including overcenter spring means for biasing said rollers in said material receiving position or said material engaging position once said rollers have been positioned in one of said two positions.

42. The invention defined in claim 37, wherein said roller means include means for driving one of said sheet material parts whereby to avoid bulging of said sheet material and improve the slitting action by said rollers.

43. The invention defined in claim 42, wherein said roller means include means for enabling slippage between said one sheet material part relative to said roller means.

44. Apparatus for cutting sheet material, comprising:

roller means including first and second rollers, each of said rollers being formed by at least two side by side longitudinally aligned concentric cylindrical portions having relatively larger and smaller diameters whereby on each of said rollers the end edge of said larger cylindrical portion adjacent said smaller cylindrical portion defines a circular cutting edge, the difference in diameter between said larger and smaller cylindrical portions on said first roller being substantially equal to the difference in diameter between said larger and smaller cylindrical portions on said second roller;

structure means mounting said rollers in a substantially parallel disposed relationship with respect to each other with said larger cylindrical portion of one of said rollers aligned with said smaller cylindrical portion of the other and vice versa, said structure means being selectively operable on command to move said rollers between a material receiving position and a material engaging position, said rollers being spaced apart in said material receiving position and being positioned together in a rotatably cooperating relationship in said material engaging position with said defined circular cutting edges overlapping and positioned adjacent eact other, said rollers being operable in said material engaging position to engage a piece of sheet material fed therebetween to slit the material into separate parts by the rotating action of said cutting edges; and motor means responsive to the positioning of said rollers for driving said rollers whenever said rollers are positioned in said material engaging position thereby to feed a piece of sheet material therebetween.

45. The invention defined in claim 44, including annular frictional contact surfaces formed around said rollers for engaging a piece of sheet material fed therebetween.

46. The invention defined in claim 44, wherein said larger cylindrical portions on said rollers have different diameters whereby said rollers rotate at different rates when positioned together in said rotatably cooperating relationship to engage a piece of sheet material fed therebetween thereby to increase the cutting action of said cutting edges.

47. The invention defined in claim 44, wherein said structure means is operable to pivot said rollers on command between said material receiving position and said material engaging position.

48. The invention defined in claim 44, wherein said roller means include means for driving one of said sheet material parts faster than the other of said sheet material parts whereby to avoid bulging of said sheet material and improve the slitting action by said rollers.

49. The invention defined in claim 48, wherein said roller means include means for enabling slippage between said one sheet material part relative to said roller means.

* * * * *